US010989186B2

(12) United States Patent
Krusch et al.

(10) Patent No.: US 10,989,186 B2
(45) Date of Patent: Apr. 27, 2021

(54) OPERATING METHOD AND ACTUATION DEVICE FOR A PISTON PUMP

(71) Applicant: Robert Bosch GmbH, Stuttgart (DE)

(72) Inventors: Andrea Krusch, Ludwigsburg (DE); Andreas Gutscher, Markgroeningen (DE); Siamend Flo, Schwieberdingen (DE); Thorsten Allgeier, Untergruppenbach (DE); Walter Maeurer, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 574 days.

(21) Appl. No.: 15/546,302

(22) PCT Filed: Sep. 4, 2015

(86) PCT No.: PCT/EP2015/070262
§ 371 (c)(1),
(2) Date: Jul. 26, 2017

(87) PCT Pub. No.: WO2016/119919
PCT Pub. Date: Aug. 4, 2016

(65) Prior Publication Data

US 2018/0023557 A1 Jan. 25, 2018

(30) Foreign Application Priority Data

Jan. 28, 2015 (DE) ..... 10 2015 201 466.5

(51) Int. Cl.
*F04B 49/06* (2006.01)
*F04B 17/04* (2006.01)
(Continued)

(52) U.S. Cl.
CPC ..... *F04B 49/06* (2013.01); *F04B 17/04* (2013.01); *F04B 17/042* (2013.01);
(Continued)

(58) Field of Classification Search
CPC ..... F04B 49/06; F04B 49/065; F04B 49/12; F04B 17/04; F04B 17/044; F04B 17/048;
(Continued)

(56) References Cited

U.S. PATENT DOCUMENTS 5,342,176 A * 8/1994 Redlich ..... F04B 35/045 318/687
5,442,515 A * 8/1995 Wallaert ..... H01F 7/1805 123/490
(Continued)

FOREIGN PATENT DOCUMENTS

CN 1975141 A 6/2007
CN 102472188 A 5/2012
(Continued)

OTHER PUBLICATIONS

International Search Report for Application No. PCT/EP2015/070262 dated Apr. 6, 2016 (English Translation, 3 pages).

*Primary Examiner* — Christopher S Bobish
(74) *Attorney, Agent, or Firm* — Michael Best & Friedrich LLP

(57) ABSTRACT

The invention relates to a method for operating a piston pump (10) which is driven by means of a coil (1) of an electromagnet. A piston (2) of the piston pump (10) can be moved in a cylinder (3) for pumping purposes by means of the electromagnet. A voltage (U) is applied to the coil (1) during a switch-on period such that a current flows through the coil (1) and the piston (2) is accelerated, said voltage being applied by means of an actuation device (11). A time curve of an electric state variable (I, U) of the coil (1) is qualitatively detected, and the curve or a curve derived therefrom is analyzed in order to detect an impact of the piston (2) against a stop. The invention further relates to an actuation device and a piston pump.

14 Claims, 5 Drawing Sheets

(51) Int. Cl.

| | |
|---|---|
| ***F04B 35/04*** | (2006.01) |
| ***F04B 49/12*** | (2006.01) |
| ***F04B 19/22*** | (2006.01) |
| ***F04B 53/14*** | (2006.01) |

(52) U.S. Cl.
CPC ..... *F04B 17/044* (2013.01); *F04B 17/048* (2013.01); *F04B 19/22* (2013.01); *F04B 35/045* (2013.01); *F04B 49/065* (2013.01); *F04B 49/12* (2013.01); *F04B 53/14* (2013.01); *F04B 2201/0206* (2013.01); *F04B 2203/0401* (2013.01); *F04B 2203/0402* (2013.01); *F04B 2203/0403* (2013.01); *F04B 2203/0404* (2013.01)

(58) Field of Classification Search
CPC ..... F04B 17/042; F04B 35/045; F04B 19/22; F04B 2201/0206
See application file for complete search history.

(56) References Cited

U.S. PATENT DOCUMENTS

| | | | | |
|---|---|---|---|---|
| 5,496,153 | A * | 3/1996 | Redlich | F04B 35/045 318/687 |
| 6,153,951 | A * | 11/2000 | Morita | F04B 35/045 310/12.27 |
| 6,554,577 | B2 * | 4/2003 | Park | F04B 35/045 417/18 |
| 6,685,438 | B2 * | 2/2004 | Yoo | F04B 35/045 417/22 |
| 7,168,925 | B2 * | 1/2007 | Humphries | F04B 17/04 417/413.1 |
| 7,663,275 | B2 * | 2/2010 | McGill | F04B 35/045 310/68 R |
| 8,197,220 | B2 * | 6/2012 | Sung | F04B 35/045 417/44.11 |
| 8,784,069 | B2 * | 7/2014 | Lilie | F04B 35/045 417/44.1 |
| 8,926,296 | B2 * | 1/2015 | Dainez | F04B 35/045 417/417 |
| 8,952,635 | B2 * | 2/2015 | Kwon | H02K 7/14 318/3 |
| 9,995,298 | B2 * | 6/2018 | Lim | F04B 35/045 |
| 2006/0044003 | A1 * | 3/2006 | Turner | G01R 19/0092 324/762.09 |
| 2007/0241697 | A1 * | 10/2007 | Sung | F04B 35/045 318/135 |
| 2011/0008191 | A1 * | 1/2011 | Lilie | F04B 35/045 417/410.1 |
| 2014/0092516 | A1 * | 4/2014 | Koch | F02D 41/20 361/160 |

FOREIGN PATENT DOCUMENTS

| | | | |
|---|---|---|---|
| DE | 102011004309 | | 8/2012 |
| DE | 102011005672 | | 9/2012 |
| EP | 2662555 | | 11/2013 |
| JP | S58214081 | A | 12/1983 |
| JP | 2001221121 | A | 8/2001 |
| WO | 9413991 | | 6/1994 |
| WO | 2009092788 | | 7/2009 |
| WO | 2009092788 | A2 | 7/2009 |
| WO | 2014154119 | | 10/2014 |

* cited by examiner

OPERATING METHOD AND ACTUATION DEVICE FOR A PISTON PUMP

BACKGROUND OF THE INVENTION

The present invention relates to a method for operating a piston pump, which is driven by means of a coil of an electromagnet, wherein, by means of the electromagnet, a piston of the piston pump is moveable in a cylinder for the execution of a pump action, wherein, during a switch-in time, a voltage is applied to the coil, such that a current flows in the coil and the piston is accelerated, wherein the voltage is applied by means of an actuation device. The invention further relates to an actuation device for a piston pump for the conveyance of a fluid, specifically a fuel, having a cylinder, a piston and an electromagnet with a coil for the movement of the piston in the cylinder. The invention moreover relates to a piston pump.

Piston pumps are known from the prior art which are driveable by means of the coil of an electromagnet. These can be employed, for example, as fuel pumps. For exemplary purposes, one embodiment of a pump of this type as a lifting armature pump is represented in FIG. 1. The piston pump comprises a coil 1, a piston 2 having a piston head 4, a cylinder 3, a helical spring 5 having an abutment 6 and a valve unit 7. When a current flows in the coil 1, a magnetic flux is generated through the interior thereof. Consequently, the piston 2 is magnetically repelled from the valve unit 7, as a result of which the helical spring 5 is pretensioned against its abutment 6. The volume between the valve unit 7 and the piston head 4 expands, thereby resulting in an intake process. Significantly, once the working stroke reaches a maximum position at a limit stop 8, the current in the coil 1 is switched out, such that the piston remains on the limit stop 8, thereby permitting the complete execution of the intake process. By the pretensioning of the helical spring 5, the piston 2 is then moved in the direction of the valve unit 7, such that a discharge process occurs, by means of which the fluid to be pumped is displaced into the valve unit 7. A pump is also conceivable, in which discharge is executed by means of a magnetic action, and intake is executed by means of a spring action.

For the actuation of a piston pump of this type, an acuation unit is known, as represented in FIG. 2. A coil, which has an inductive part L_coil_pump and a resistive part L_coil_pump, is connected to a supply voltage +UB. A semiconductor switch HS, which is configured as a n-channel MOSFET, is connected in series with the coil. The semiconductor switch HS is connected to a ground potential GND via a shunt resistor R_shunt, and can be controlled via a series resistor Rv_LS. By the opening and closing of the semiconductor switch HS, a voltage U_coil_pump can be applied to the coil. A current thus flows in the coil. The same current also flows in the shunt resistor R_shunt, on which the magnitude thereof can be determined by the measurement of a voltage drop U_shunt.

The prior art has a disadvantage, in that the piston pump generates noise associated with the impact of the piston against a limit stop which defines the limit position of the working stroke. Moreover, the efficiency of the piston pump associated with the aforementioned actuation function and the conventional form of actuation is not ideal.

SUMMARY OF THE INVENTION

According to the invention, a method is disclosed for the operation of a piston pump, wherein a time characteristic of an electrical state variable of the coil is qualitatively determined. A state variable can be a current in or a voltage on the coil. It is also conceivable for a quotient or other variables derived from current and voltage to be detected and/or calculated. Qualitative detection signifies that no absolute values, for example a measured voltage, are involved, but that detection by way of a characteristic will suffice. However, quantitatively reliable detection is also included in the scope thereof. According to the invention, it is further proposed that a detected characteristic, or a characteristic derived therefrom, is evaluated in order to determine a characteristic for the impact of the piston on a limit stop. By the detection of the impact of the piston, a reference point in the characteristic of the pumping process is made available, by means of which a substantially improved control or regulation of the pump is made possible. The actuation device for the piston pump can be an element of a control device of a motor vehicle. The method can be executed by the actuation device and/or the control device.

In one form of embodiment it is proposed that an impact time point is detected, at which the piston engages with the piston seating. In this manner, the necessity for the employment of a displacement measurement system is avoided.

In a further form of embodiment, the impact time is detected wherein, in a first temporal derivation of the detected characteristic of the electrical state variable of the coil, an extreme value is determined, and the time thereof is determined as the impact time point. Alternatively or additionally, it is possible for a zero-crossing in a second temporal derivation of the electrical state variable to be detected as the impact time point. This is justified in that, upon the impact of the piston against the limit stop, the speed thereof is abruptly reduced. The speed of the piston generates a counter-voltage in the coil, which is altered by the impact. This results in a disturbance to the uniformity of the detected characteristic, which manifests as a kink. Such deviations in uniformity can be detected more effectively by the temporal derivation of the characteristic, and the automatic evaluation thereof is also improved accordingly.

Alternatively or additionally to the aforementioned detection method, it is conceivable for the time characteristic of the state variable to be subtracted from a temporal reference characteristic, thus resulting in a differential characteristic. In a reference characteristic of this type, it is simulated that the piston does not move, or that the piston is not stopped in its travel. The differential thus incorporates an extreme value at the point in the piston stroke where the piston is subject to impact, wherein the associated time point can be defined as the impact time point. Specifically, the current characteristic is employed for differential generation. The reference characteristic can be stored in a control device, specifically in a control device of a motor vehicle, which incorporates the actuation device for the piston pump or can communicate with the latter. It is also conceivable than an intelligent actuation device can be employed, in which the reference characteristic is stored.

For the determination of the reference characteristic, shortly after the start of energization of the coil, the rising gradient of the characteristic can be established. From this value, the inductance of the coil can be concluded. Additionally, a test pulse control function can be executed on the coil by means of a voltage pulse, the duration of which is sufficient to achieve the saturation of the coil. By this process, a saturation value for the coil can be determined, for example a maximum current flowing in the coil. From this saturation value, parameters for the coil can be derived, for example, the internal resistance thereof. From the temporal transition to saturation, the inductance of the coil can be calculated. A further option for the determination of parameters on the coil involves the measurement of the coil voltage upon the switch-out of the coil. By this arrangement, the actual characteristic of the measured voltage can be subtracted from a switch-out reference voltage curve, and an extreme value identified. Accordingly, a time point can be determined at which the piston disengages from the limit stop. By the application of the aforementioned determination methods, parameters are available by means of which the theoretical calculation of a reference curve can be executed, with the application of values which have been measured on a production piston pump. The reference characteristic is thus more realistic.

In a further form of embodiment, it is proposed that the impact time point is saved, further to the detection thereof. This has an advantage, in that the impact time point does not need to be continuously redefined. It is specifically preferred that an impact time point is detected for a specific operating state. Accordingly, an impact time point detected can be saved in association with parameters which are characteristic of an operating state. Primarily, these are the pumping frequency and the working stroke of the pump; however, a pump or fluid temperature is also conceivable as a parameter. It is possible for the impact time point to be reidentified in conjunction with each change of operating state, or the impact time points associated with a plurality of operating states can be saved, such that any new determination is only required rarely, if at all. It is conceivable that, in a data record, only measured impact time points for a production piston pump which is associated with said data record are saved.

In a further form of embodiment, the energization of the coil is terminated if an impact time point is detected. In this manner, a supply voltage is prevented from still being present on the coil, even though the piston has reached the limit stop. As a result of the non-abrupt interruption of the magnetic effect, the piston typically remains in contact with the limit stop for a certain time following the switch-out of the supply voltage. It is also conceivable for the supply voltage to the coil to be switched out if, further to the start of energization, a time point is reached which corresponds to a saved impact time point. Specifically, such an impact time point is saved for a specific operating state. As a result of the reduced duration of application of the supply voltage, energy is saved.

In a further form of embodiment, energization is terminated before an anticipated, and specifically a saved impact time point is reached. In this manner, energy can be employed for the pumping process which, further to the termination of energization, is conserved in the momentum of the piston in the form of kinetic energy, and in the electromagnet in the form of magnetic energy, by means of which the piston reaches the limit stop, with no further input of energy. Energy losses in the coil, and in a terminal stage of the actuation device, are reduced accordingly. In some cases, the proportion of time between the start of energization and the impact time point, during which energization is prematurely switched-out, is one quarter or less. As a result of the early switch-out of energization, the piston reaches the limit stop at a significantly lower speed. This results in a reduction of noise, and a simultaneous reduction of wear. It is also conceivable for the supply voltage to be switched-in once more after a time interval within which the piston is subject to no further acceleration, or is braked. Preferably, a control function is executed, by means of which the energization time is set to the minimum duration which is required for the breakaway of the piston. It can also be determined, for example, whether the piston only has a very low residual speed at the time of impact, or whether no further impact of the piston upon the limit stop is occurring. The energization time can then be increased. Conversely, in the event of a high speed at the time of impact, the energization time can be reduced. Speed at the time of impact can be determined, for example, as a measure of the variation of the current in the coil upon impact, or with reference to the resulting voltage on the coil further to the switch-out of energization. Preferably, an electric power loss on the coil can be minimized, at least in an approximate manner.

The two forms of embodiment of the method described hereinafter are to be considered as forms of embodiment of an independent invention, which is independent of the other inventions described in the present application. The independent invention described hereinafter is a further development of a method for operating a piston pump which is driven by means of an electromagnet, wherein a piston of the piston pump can be moved in a cylinder for pumping purposes by means of the electromagnet, wherein a voltage is applied to the coil during a switch-in period, such that a current flows in the coil and the piston is accelerated, said voltage being applied by means of an actuation device. The applicant reserves the option to file a separate application in respect of the invention. The forms of embodiment described hereinafter can be combined with the other forms of embodiment of the method described.

In one form of embodiment, on the basis of the time characteristic of the electric voltage further to the switch-out of the energization of the coil, the conveyance of vapor can be detected. If, further to the intake of a liquid medium, for example a fuel, a vaporized form of the liquid medium is also present in the pump body, the piston is accelerated very rapidly by a discharge force, such that the vapor is compressed. As a result of the high speed of the piston, this gives rise to an increased counter-voltage, which is generated in the coil by the motion of the piston. In this manner, the voltage characteristic on the coil exhibits a significant dip. Specifically, in association with this voltage dip, the presence of vapor in the liquid medium can be identified.

In a further form of embodiment, the voltage dip can be detected wherein, further to the decay of current in the coil associated with the switch-out of energization, during a time interval prior to the further energization of the coil, an average value is constituted from the voltage on the coil, said average value is deducted from the voltage characteristic, and an extreme value is identified from the result of subtraction. If this exceeds a threshold value, the conveyance of a vapor can be detected. Alternatively or additionally, conveyance of vapor can be identified from a derivation of the voltage characteristic in the aforementioned time interval, wherein the derivation exceeds a threshold value.

According to a further aspect of the invention, an actuation device is proposed which is designed for the execution of a method according to one of the aforementioned forms of embodiment. The actuation device can be arranged on the piston pump; however, it can also be arranged separately from the piston pump, and is connected or connectable to the latter by means of electrical leads. It is also conceivable that the actuation device constitutes an element of another control device, specifically an element of an engine control device of a motor vehicle.

In a further form of embodiment, which is independent of the aforementioned form of embodiment, an actuation device is proposed for a piston pump for the conveyance of a liquid, specifically a fluid, having a cylinder, a piston, and an electromagnet with a coil for the movement of the piston in the cylinder, which is designed for the qualitative detection of a time characteristic of an electrical state variable on the coil and for the evaluation of said characteristic, or a characteristic derived therefrom, in order to detect the impact of the piston against a limit stop.

In a further form of embodiment of the actuation device according to one of the aforementioned forms of embodiment, by means of the actuation device, an impact time point of the piston, at the which the piston engages with a piston seating, is detectable on the basis of the characteristic of the electrical state variable, and specifically is storable.

In a further form of embodiment according to one of the aforementioned forms of embodiment of the actuation device, a time interval for the application of the supply voltage to the coil is set such that the coil, after the end of said time interval, reaches the limit stop as a result of its momentum, and reaches the limit stop at a substantially lower speed, specifically in comparison with its maximum speed. It is conceivable, further to the reduction in the infeed of energy to the coil associated with the switch-out of the supply voltage, that the supply voltage is re-applied before the piston reaches its limit stop.

In a further form of embodiment of one of the aforementioned forms of embodiment of the actuation device, the latter is designed to terminate the energization of the coil upon the detection of the impact time point, or on the basis of a previously identified and saved impact time point, specifically for a particular operating state, to terminate the energization of the coil at the saved impact time point, or at a time point which is determined therefrom.

In a further form of embodiment of one of the aforementioned forms of embodiment of the actuation device, the latter is designed to detect the conveyance of vapor on the basis of the time characteristic of the electric voltage on the coil.

The forms of embodiment of the actuation device described hereinafter are to be considered as an independent invention, which is independent of the other inventions described in the present application. The invention described hereinafter is independently further constituted of an actuation device for a piston pump for the conveyance of a fluid, specifically a fuel, having a cylinder, a piston and an electromagnet with a coil for the movement of the piston in the cylinder. The applicant reserves the option to file a separate application in respect thereof. The forms of embodiment described hereinafter can be combined with the aforementioned form of embodiment of the actuation device.

In one form of embodiment of the actuation device, the latter incorporates a semiconductor switch, for example a MOSFET transistor, a bipolar transistor or another semiconductor switch. By means of the semiconductor switch, a voltage can be applied to the coil. To this end, the semiconductor switch is preferably arranged in series with the coil, wherein, specifically, a terminal of the coil is connected to a terminal of the semiconductor switch in a conductive manner. The semiconductor switch and the coil preferably lie between a supply voltage potential and a ground potential, to which the coil and the semiconductor switch are connected respectively by means of a terminal. Preferably, only the semiconductor switch and the coil are arranged in the current path between the supply potential and the ground potential. If the semiconductor switch is conductive, the latter has an at least approximately constant internal resistance. The core concept of this form of embodiment is employment of the conductive semiconductor switch as a shunt resistor for the measurement of current in the semiconductor switch. In this manner, a conventional shunt resistor, which is employed for current measurement in the prior art, can be omitted. A power loss on the shunt resistor can also be avoided accordingly. Minor deviations in the constancy of the resistance of the conductive semiconductor switch do not impair the detection of the impact time point according to one of the aforementioned methods, such that this type of qualitative current measurement can be employed, even if the quantitative accuracy of measurement would not be sufficient for many other purposes. Preferably, a voltage drop is measured across the semiconductor switch, specifically using an analog-digital converter. The coil current can be calculated, at least approximately, using a resistance value for the closed semiconductor switch.

In a further form of embodiment, the voltage drop is measured across the closed semiconductor switch on one terminal of the semiconductor switch, with reference to the ground potential, or on one terminal of the semiconductor switch, with reference to the supply voltage potential.

In a further form of embodiment, the voltage on the coil is calculated, whereby the voltage measured across the semiconductor switch is subtracted from the difference between the supply voltage potential and the ground potential, wherein the voltage is measured when the semiconductor switch is open. Given that, in many cases, the difference between the supply voltage potential and the ground potential, in the form of an operating voltage, is known or can be determined from other measurements, the measurement of a voltage across the open semiconductor switch for the determination of the voltage on the coil involves only a limited element of additional complexity. The measurement of the voltage drop across the closed semiconductor switch can be executed using an analog-digital converter, by means of which moreover, the voltage across the open semiconductor switch can be measured. Under certain circumstances, a measuring range adjustment is required, which can be achieved, for example, using a voltage divider.

In a further form of embodiment, the coil is connected in parallel with a current path, which comprises an additional semiconductor switch and a diode. With respect to the direction of current flow from the supply voltage potential to the ground potential, the diode is arranged in a blocking direction. The additional semiconductor switch, further to the switch-out of the semiconductor switch for the application of the supply voltage potential, permits the isolation of a freewheeling circuit for the flow of current in the coil. This permits the slow decay of current in the coil.

In a further form of embodiment, a Zener diode is connected in parallel with the semiconductor switch for the application of the supply voltage potential which, with respect to the direction of current flow from the supply voltage potential to the ground potential, is arranged in the blocking direction. This Zener diode permits the rapid extinction of the energy of the coil in the Zener diode. If the semiconductor switch is switched to a blocking state, current flows from the coil, which continues to operate on the grounds of its magnetic energy, via said Zener diode and a power supply device, which delivers the supply voltage potential, back to the coil. As a result of its breakdown voltage, the substantial conversion of energy into heat occurs in the Zener diode, such that the coil current is rapidly extinguished.

According to a further aspect of the invention, a piston pump is disclosed which comprises an actuation device according to one of the aforementioned forms of embodiment.

BRIEF DESCRIPTION OF THE DRAWINGS

Exemplary embodiments of the invention are described in detail hereinafter, with reference to the attached drawings. In the drawings.

DETAILED DESCRIPTION

Figure 1:
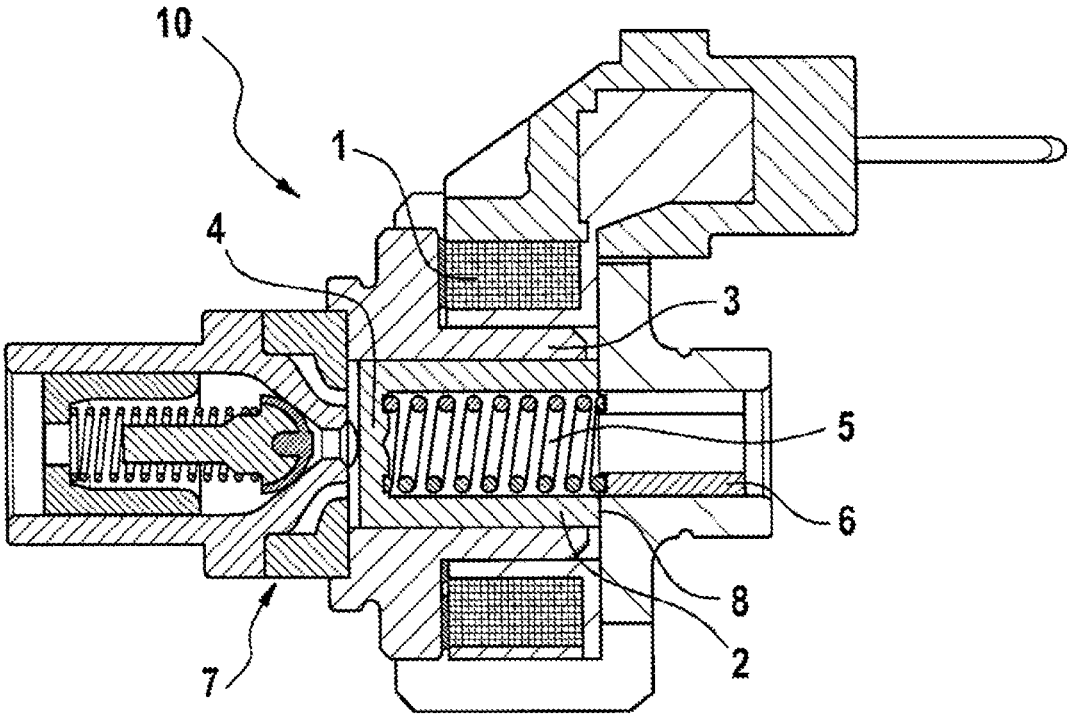
FIG. 1 shows a cross section of a piston pump according to the prior art.
Figure 2:
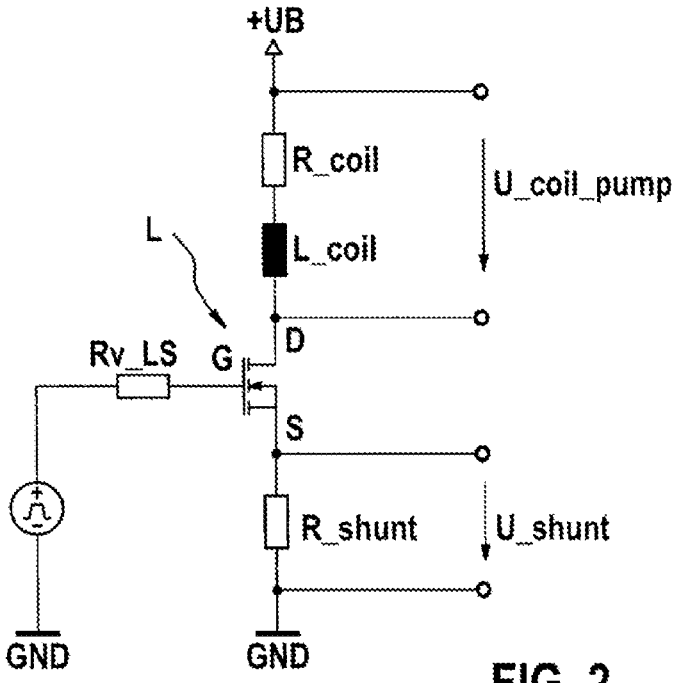
FIG. 2 shows a circuit diagram of an actuation device according to the prior art.
Figure 3:
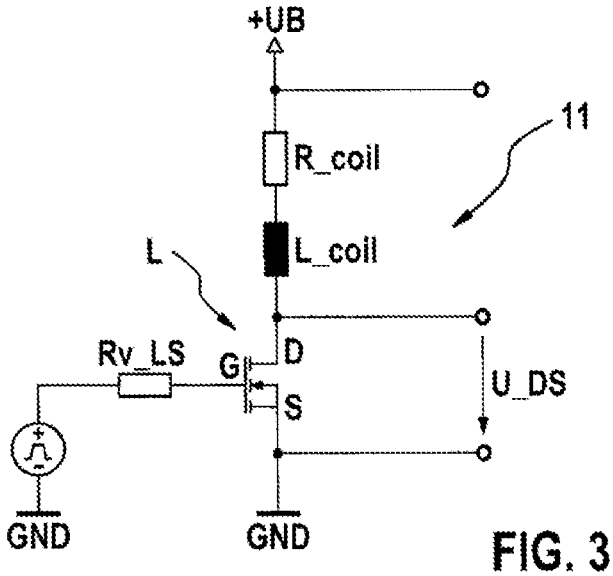
FIG. 3 shows a circuit diagram of a first form of embodiment of an actuation device according to the invention.

FIG. 3 shows a circuit diagram of an actuation device, as an element of the invention. This element of the invention is of independent significance. The applicant reserves the option to file a separate application in respect of this subject matter. The actuation device represented can form part of a more extensive unit. Between a supply voltage potential +UB and a ground potential GND, a coil of an electromagnet of a piston pump and a semiconductor switch LS are connected in series. The semiconductor switch LS is configured as a n-channel MOSFET transistor. Alternatively, the semiconductor switch LS can also be configured as a p-channel MOSFET transistor. A source terminal S of the transistor is connected to the ground potential GND. A drain terminal D is connected to one terminal of the coil. The gate terminal G is connected to an actuation potential via a series resistor Rv_LS. A voltage drop U_DS can be tapped-off between the drain D and the source S. The voltage drop can be employed from the measurement of a current flowing in the coil L_coil. The coil comprises an inductive element L_coil and a resistive element R_coil, which are connected in series. One terminal of the coil is connected to the supply voltage potential +UB, whereas the other terminal is connected to the semiconductor switch HS.

Figure 4:
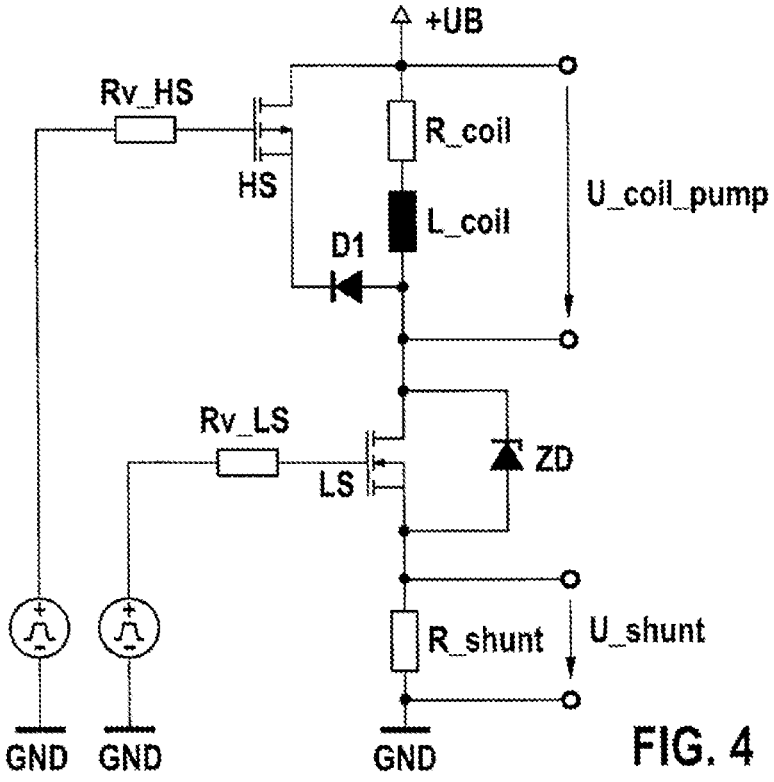
FIG. 4 shows a circuit diagram of a second form of embodiment of an actuation device according to the invention.

FIG. 4 shows a circuit diagram of a second form of embodiment of the actuation device. In many respects, the second form of embodiment is identical to the first form of embodiment, which is represented in FIG. 3. Equivalent characteristics are identified by the same reference symbols, and reference is made to FIG. 3 in relation thereto. Only the differences from FIG. 3 will be described hereinafter. The second form of embodiment is additionally provided with a Zener diode, which is connected to the drain and source of the semiconductor switch LS and, with respect to the supply voltage potential +UB, is connected in a blocking direction. The actuation device is further provided with an additional current path, having a series-connected arrangement of a further semiconductor switch HS and a diode D1 which, with respect to the supply voltage potential +UB, is arranged in the blocking direction. The drain of the semiconductor switch HS is connected to the supply voltage potential +UB. The anode of the diode D1 is connected to the drain of the semiconductor switch LS. The source of the semiconductor switch HS and the cathode of the diode D1 are interconnected. The semiconductor switch HS can be actuated via its gate and a series resistor Rv_HS. The circuit incorporates a shunt resistor, on which a voltage U_shunt can be tapped for the measurement of a current flowing in the coil L_coil.

For the energization of the coil L_coil, the semiconductor switch LS is switched to a conducting state. Once a switch-in time has expired, the semiconductor switch LS is opened. The coil L_coil then generates a voltage U_coil_pump. This drives a current through a freewheeling circuit. The function of the semiconductor switch HS is the activation of a freewheeling circuit with a low impact, which runs through the diode D1 and the closed semiconductor switch HS connected thereto. As the voltage drop on the closed semiconductor switch HS and the diode D1 is small, energy is only discharged slowly from the coil L_coil, such that the coil current is extinguished slowly. Conversely, if the semiconductor switch is open, a strong extinction effect is generated. The current path of the current driven by the coil is then routed via the Zener diode ZD, the shunt resistor R_shunt and a power supply device, which delivers the supply voltage potential +UB. The high energy loss results in the rapid extinction of the current flowing in the coil L_coil.

Figure 5:
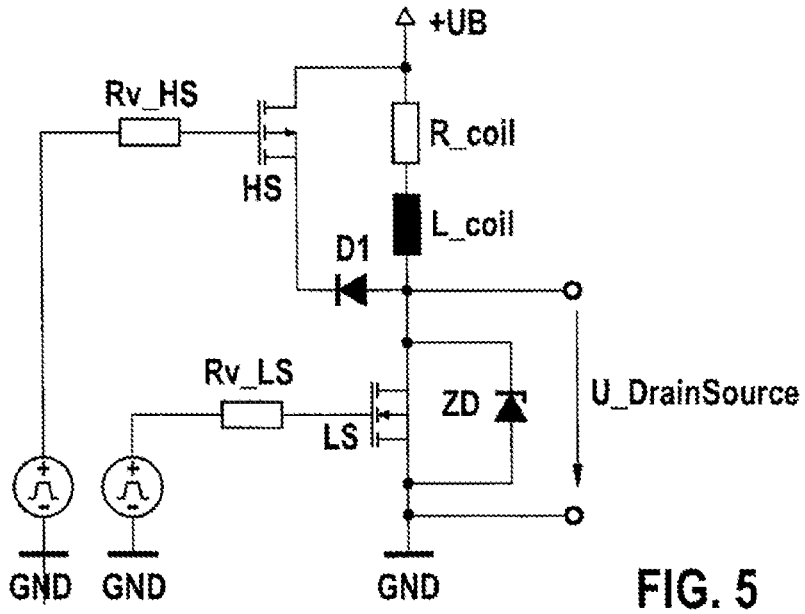
FIG. 5 shows a circuit diagram of a third form of embodiment of an actuation device according to the invention.

FIG. 5 shows a variant form of embodiment of the form of embodiment represented in FIG. 4. Equivalent characteristics are identified by the same reference symbols, and reference is made to FIG. 4 in relation thereto. Only the differences will be described hereinafter. By way of a difference from FIG. 4, the form of embodiment represented in FIG. 5 is lacking the shunt resistor R_shunt. In its place, as in the form of embodiment represented in FIG. 3, a voltage U_DS across the closed semiconductor switch LS is employed for the measurement of the current flowing in the coil L_coil.

Figure 6:
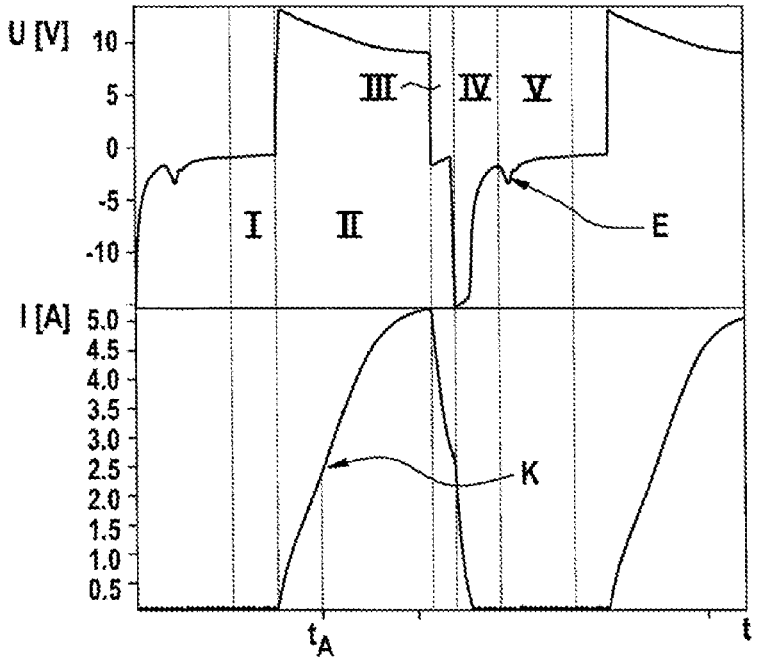
FIG. 6 shows a double diagram, in which a voltage on the coil and a current in the coil are plotted over a time interval which is common to both, wherein a conventional current and voltage characteristic is represented.

FIG. 6, in a double diagram, represents a characteristic of a voltage U, which is present on the coil of an electromagnet of a piston pump, and a characteristic of a current I flowing in the coil, wherein the current I and the voltage U are plotted against time t and are represented over the same time interval. An actuation device in one of the forms of embodiment according to FIG. 4 or 5 is employed. In a first time segment I, the voltage U assumes an approximately constant value of zero, and the current I likewise is essentially at zero. The piston lies against a rest stop, or executes a slow expulsion motion for the pumping of fluid. At the transition from time segment I to time segment II, the supply voltage is applied to the coil, such that the voltage U shows a rapid and substantial rise. As a result of the inductance and the internal resistance of the coil, there is a time lag in the trailing current in the coil I, which rises slowly and reaches its maximum value at the end of the time segment II. The rising ramp commences with an approximately constant gradient which, however, is impaired by a minor irregularity at the kink K. This is attributable to the fact that, at the start of the kink, at an impact time point tA, the piston of the piston pump engages with a limit stop, as a result of which its speed is strongly reduced and the piston thus generates no further counter-voltage. The time point of the kink thus corresponds to an impact time point. In accordance with the strong reduction in the speed of the piston, a larger effective voltage is present on the coil, such that the current I, with effect from this impact time point, rises with a steeper ramp. This rising ramp becomes progressively less steep up to the end of time segment II. At the end of time segment II, the coil is isolated from the supply voltage. To this end, the semiconductor switch LS is switched to a blocking state. The semiconductor switch HS is switched to a conducting state, such that only a weak extinction of the coil current occurs. Accordingly, the voltage U drops very rapidly to a sub-zero value, where it remains during time segment III. In time segment III, as a result of the aforementioned setting of the semiconductor switches LS and HS, the current I decays slowly. In time segment IV, the voltage U drops rapidly and very strongly, which is associated with a rapid and strong reduction in the current I to a value close to zero. This is effected by the switch-out of the semiconductor switch HS which, as described above, is associated with a strong extinction of current. At the end of the drop in current, the voltage U rapidly rises again to an approximate value of zero. In time segment V, the piston, as a result of the termination of the magnetic action of the coil, is reset in motion by the spring bias. This results in the generation of a counter-voltage in the coil, which can be identified by a dip in the characteristic of the voltage U. Although the piston is accelerated, the action of the motion of the piston in the time characteristic declines up to the end of time segment V. During the latter, the current I is close to zero. At the end of the time segment V, the cycle begins again from the start with time segment I.

Figure 7:
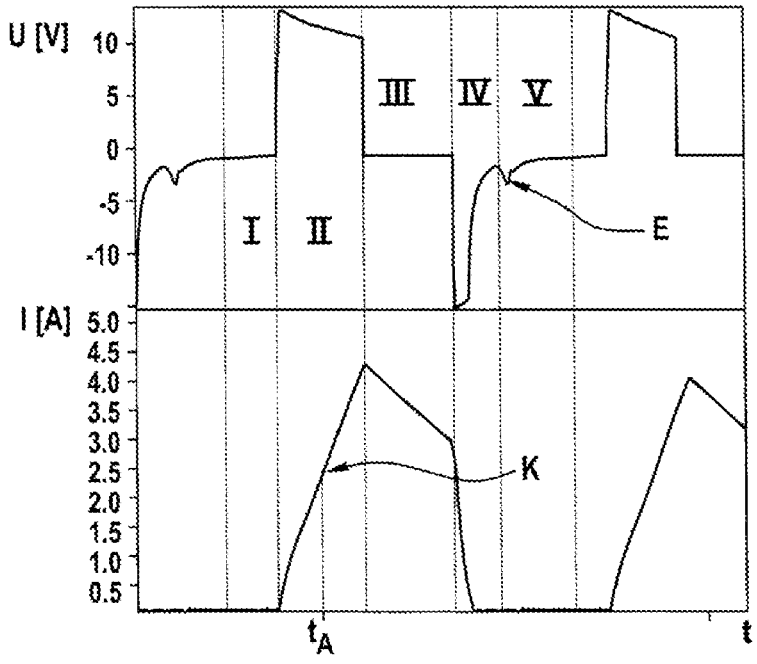
FIG. 7 shows a double diagram, in which a voltage on the coil and a current in the coil are plotted over a time interval which is common to both, wherein a current and voltage characteristic is represented according to the application of a first form of embodiment of the invention.

FIG. 7 shows a variant of the double diagram of voltage U and current I plotted against time t, as represented in FIG. 6. The same time period is represented as in FIG. 4. The characteristics of the voltage U and the current I substantially correspond to the characteristics represented in FIG. 6. Consequently, only the differences will be described here. The main difference between FIGS. 6 and 7 is that the transition between time segments II and III occurs at an earlier time. Time segment II is thus shortened, whereas time segment III is extended. Time segment II ends approximately after the time of the kink K, wherein the coil is isolated from its supply voltage. The acceleration of the piston is thus terminated early, such that the latter, as a result of this load step, and as a result of the only slow decay in the magnetic action and in the current I which continues to flow in the coil, continues to run, and engages with its limit stop at a comparatively reduced speed. This results in a reduction in noise, and a reduction in wear. In time segment III, the voltage U drops to a sub-zero value. The current I thus decays slowly to lower values. The remainder of the cycle for the voltage U and the current I corresponds to that represented in FIG. 6. Overall, substantially lower energy consumption is achieved in comparison with figure three, as a result of the abbreviated duration of application of the supply voltage and the lower maximum current strength, together with the reduced charging flux, as can be seen from the area below the characteristic current curve I.

Figure 8:
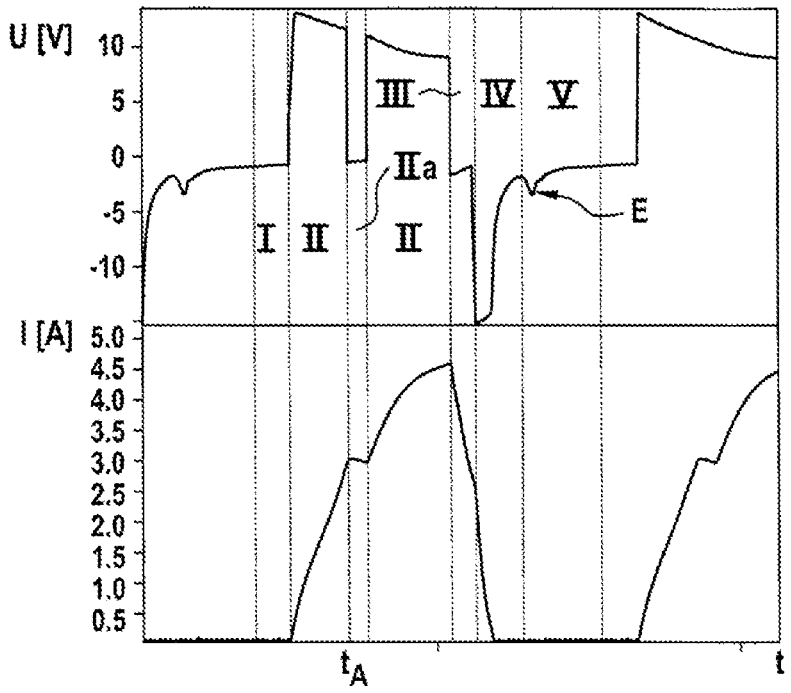
FIG. 8 shows a double diagram, in which a voltage on the coil and a current in the coil are plotted over a time interval which is common to both, wherein a current and voltage characteristic is represented according to the application of a second form of embodiment of the invention.

FIG. 8 shows a variant of the double diagram of voltage U and current I plotted against time t, as represented in FIG. 6. The same time period is represented as in FIG. 6. The characteristics of the voltage U and the current I substantially correspond to the characteristics represented in FIG. 6. Consequently, only the differences will be described here. The main difference between FIGS. 6 and 8 is that, in the voltage characteristic represented in FIG. 8, an additional time segment IIa is incorporated in the characteristic of time segment II. During time segment IIa, the supply voltage falls to zero. To this end, the semiconductor switch LS is open. The semiconductor switch HS remains closed or is opened, depending upon whether a strong or a weak current extinction is required. The time segment IIa corresponds to a temporal braking segment, during which the speed of the piston and/or the acceleration thereof is reduced, wherein the supply voltage to the coil is switched-out. During time segment IIa, the current I declines somewhat, whereas during time segment II, which encompasses time segment IIa, it rises rapidly. Preferably, time segment IIa commences at the kink K, at the point where the piston engages with its limit stop. Overall, a significantly lower energy consumption is achieved, specifically in that the current reaches a lower maximum value. The overall charging flux is reduced. During time segment IIa, moreover, the supply voltage is switched-out such that, during this time interval, there is no input of energy. As a result of the lower input of energy to the piston, the latter engages with its limit stop at a lower speed, thereby reducing noise and wear. The length of time segment IIa can serve as a manipulated variable for the setting of an optimum duration of energization of the coil, in order to achieve the optimum operation of the piston pump. The remainder of the time segments in a cycle represented in FIG. 8 correspond to those represented in FIG. 6.

Figure 9:
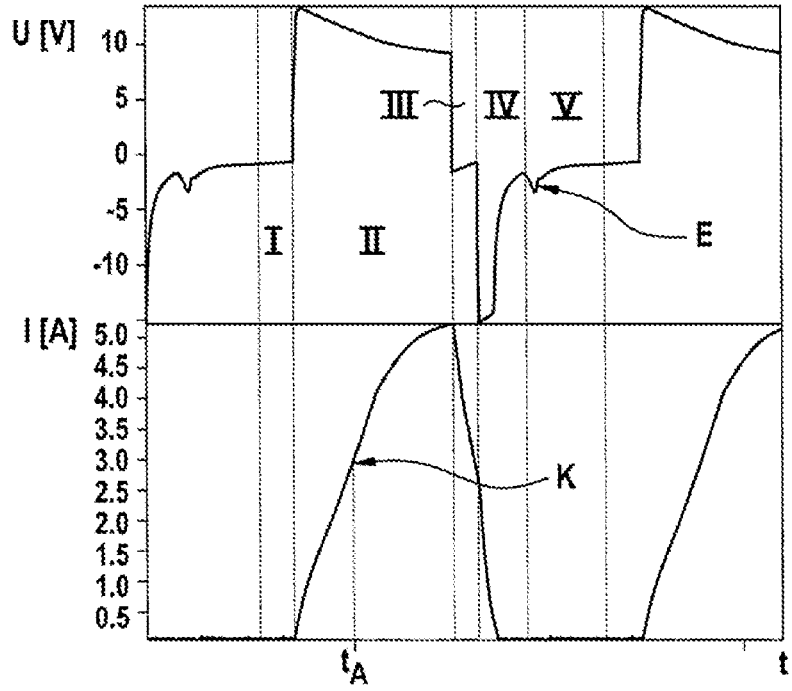
FIG. 9 shows a double diagram, in which a voltage on the coil and a current in the coil are plotted over a time interval which is common to both, wherein a conventional current and voltage characteristic is represented but wherein, however, a liquid fluid and vapor are conveyed.

FIG. 9 shows a variant of the double diagram of voltage U and current I plotted against time t, as represented in FIG. 6. The same time period is represented as in FIG. 6. The characteristics of the voltage U and the current I substantially correspond to the characteristics represented in FIG. 6. Consequently, only the differences will be described here. The main difference between FIGS. 6 and 9 is that the dip E in time segment V is significantly more prominent. This is due to the fact that FIG. 9 represents the conveyance of a mixture of a liquid fluid and a vapor thereof. At the start of time segment V, the piston is strongly accelerated, until the vapor is compressed by the rising pressure, and a medium which can be compressed no further is expelled. With reference to the magnitude or the temporal gradient of the dip E, it can be established whether or not vapor is present in the pump body. To this end, specifically, an amplitude of the dip E and/or a temporal gradient of the dip E can be compared with a threshold value.

The invention claimed is:

1. A method for operating a piston pump (10), which is driven by means of a coil (1) of an electromagnet, wherein, by means of the electromagnet, a piston (2) of the piston pump (10) is moveable in a cylinder (3) for the execution of a pump action, wherein, during a switch-in time, a voltage (U) is applied to the coil (1), such that a current flows in the coil (1) and the piston (2) is accelerated, wherein the voltage is applied by means of an semiconductor switch of an actuation device (11), and wherein a time characteristic of an electrical state variable (I, U) of the coil (1) is qualitatively determined by measuring a voltage drop across an internal resistance of the semiconductor switch (LS) and determining the current in the coil from the measured voltage drop, and the time characteristic, or a characteristic derived therefrom, is evaluated in order to determine the impact of the piston (2) on a limit stop (8), control the voltage applied to the coil (1) to accelerate the piston according to the determined time characteristic, wherein a conveyance of vapor is detected on the basis of a time characteristic of the voltage.

2. The method as claimed in claim 1, wherein an impact time point (tA) of the piston (2), at which the piston (2) engages with the limit stop (8), is determined on the basis of the time characteristic of the electrical state variables (I, U).

3. The method as claimed in claim 2, wherein the impact time point (tA) is detected and, in a first temporal derivation of the characteristic of the electrical state variables (I, U), an extreme value is temporally determined, in a second temporal derivation of the characteristic of the electrical state variables (I, U), a zero-crossing is temporally determined, or both the extreme value and the zero-crossing are determined.

4. The method as claimed in claim 2, wherein the time characteristic of the state variables (I, U) is subtracted from a temporal reference characteristic, which simulates a theoretical characteristic of the state variables (I, U) in the absence of motion of the piston, or with the piston in motion but in the absence of impact of the piston (2), and the difference is compared with a threshold value, wherein the impact time point (tA) is detected by an extreme value in said difference.

5. The method as claimed in claim 2, wherein a detected impact time point (tA) is saved.

6. The method as claimed in claim 2, wherein, upon the detection of the impact time point (tA), the voltage supply to the coil (1) is terminated or, on the basis of a previously detected and saved impact time point (tA), a time point is determined at which the voltage supply to the coil (1) is terminated, wherein, specifically after a time interval (IIa), which commences upon the termination of the voltage supply, the voltage supply is switched-in once more.

7. The method as claimed in claim 2, wherein the voltage supply is terminated before the determined impact time point (tA) is reached, or when the determined impact time point (tA) is reached.

8. The method as claimed in claim 7, wherein a voltage supply time (II) of the coil (1) is set such that, further to the end of the voltage supply time (II), the piston (2) reaches the limit stop (8) as a result of its momentum, and reaches the limit stop (8) at a substantially lower speed in comparison with its maximum speed.

9. The method as claimed in claim 1, wherein the conveyance of vapor is detected on the basis of the time characteristic of the electric voltage (U) on the coil (1).

10. The method as claimed in claim 9, wherein, further to the commencement of a discharge process of fluid from the piston pump (10), a dip (E) in the voltage characteristic (U) on the coil (1) is detected, specifically wherein a difference between the voltage characteristic and a characteristic of a reference voltage at an average value of the voltage (U) during a time interval following decay of the current in the coil (1) is determined, and an extreme value is identified in said difference which exceeds a threshold value.

11. An actuation device (11) for a piston pump (10) for the conveyance of a fluid, specifically a fuel, having a cylinder (3), a piston (2) and an electromagnet with a coil (1) for the movement of the piston (2) in the cylinder (3), wherein the actuation device (11) comprises a semiconductor switch (LS), by means of which a voltage is applied to the coil (1), and the actuation device (11) is configured to;

apply, during a switch-in time, a voltage (U) to the coil (1), such that a current flows in the coil (1), accelerating the piston (2);

qualitatively determine a time characteristic of an electrical state variable (I, U) of the coil (1) by measuring a voltage drop across an internal resistance of the semiconductor switch (LS) and determining a current in the coil from the measured voltage drop;

determine an impact of the piston (2) on a limit stop (8) by evaluating the characteristic, or a characteristic derived therefrom; and control the voltage applied to the coil (1) to accelerate the piston according to the determined time characteristic wherein a conveyance of vapor is detected on the basis of a time characteristic of the voltage (U) to the coil (1).

12. The actuation device (11) as claimed in claim 11, wherein the voltage (U_DS) across the internal resistance of the semiconductor switch (LS) is executed between a ground potential (GND) and one terminal of the semiconductor switch (LS) or between a voltage supply potential (+UB) and one terminal of the semiconductor switch (LS).

13. The actuation device (11) as claimed in claim 11, wherein one terminal of the semiconductor switch (LS) is connected to the same potential as a first terminal of the coil (1), and wherein a second terminal of the coil (1) is connected to a voltage supply potential or to a ground potential, wherein the actuation device (11) is configured to calculate a voltage on the coil (1) from the difference between a voltage on the terminal of the semiconductor switch (LS) and the supply voltage potential or the ground potential.

14. A piston pump (10), wherein it comprises an actuation device (11) as claimed in claim 11.

* * * * *